US005201793A

United States Patent [19]

Izumi et al.

[11] Patent Number: 5,201,793

[45] Date of Patent: Apr. 13, 1993

[54] REMOVER OF DUST OF FLOCKS, ETC. IN CIRCULAR KNITTING MACHINE

[75] Inventors: Toshiro Izumi; Hiroyuki Ueda, both of Hyogo, Japan

[73] Assignee: Precision Fukuhara Works, Ltd., Hyogo, Japan

[21] Appl. No.: 869,307

[22] Filed: Apr. 16, 1992

[30] Foreign Application Priority Data

Apr. 19, 1991 [JP] Japan ..... 3-116851

[51] Int. Cl.[5] ..... D04B 35/32

[52] U.S. Cl. ..... 66/168

[58] Field of Search ..... 66/168, 8, 13

[56] References Cited

U.S. PATENT DOCUMENTS

| | | | |
|---|---|---|---|
| 1,752,207 | 3/1930 | Seifert | 66/168 |
| 3,274,803 | 9/1966 | Schmidt | 66/168 |

FOREIGN PATENT DOCUMENTS

| | | | |
|---|---|---|---|
| 1061943 | 7/1959 | Fed. Rep. of Germany | 66/168 |
| 1585163 | 3/1972 | Fed. Rep. of Germany | 66/168 |
| 7638042 | 5/1978 | Fed. Rep. of Germany | 66/168 |
| 2708436 | 7/1978 | Fed. Rep. of Germany | 66/168 |
| 1326674 | 4/1985 | U.S.S.R. | 66/168 |
| 1146414 | 3/1969 | United Kingdom | 66/168 |

*Primary Examiner*—Clifford D. Crowder
*Assistant Examiner*—John J. Calvert
*Attorney, Agent, or Firm*—Bell, Seltzer, Park & Gibson

[57] ABSTRACT

An air ejection nozzle located above the sinker dial and needle cylinder of the machine blows fiber waste from the needle groove of the needle cylinder and toward a fiber waste collection box located below the sinker dial. The fiber waste within the box is collected by a member movable within the box by the sinker dial, and is removed from the box by a suction nozzle communicating with an outlet opening of the box.

11 Claims, 2 Drawing Sheets

REMOVER OF DUST OF FLOCKS, ETC. IN CIRCULAR KNITTING MACHINE

FIELD OF THE INVENTION

This invention relates to circulating knitting machines, and more particularly relates to an improved apparatus for removing lint, dust and similar matter, hereinafter referred to as fiber waste, from the knitting section of a circular knitting machine.

BACKGROUND OF THE INVENTION

Fiber waste generated during operation of a circular knitting machine tends to accumulate in the machine's knitting section yarn carrier, sinker, sinker cap and/or needle selector components. The fiber waste may then be knit into fabric being knitted by the machine. When this occurs, it is likely to cause damage to the fabric and also to the knitting needles of the machine. In order to reduce the possibility of such damage occurring, circular knitting machines have heretofore been provided with a plurality of air ejection pipes that are adapted to blow fiber waste off of specific parts of the machine's knitting section while undergoing rotation in a direction that is the same as or opposite to the direction of rotation of the needle cylinder of the machine. However, since the outlet opening at the tip of each air ejection pipe can direct air in only a single direction, the amount of fiber waste that can be removed by each pipe is limited. Japanese Patent publication No. Hei 1-38899 discloses a proposed improvement wherein the outlet end of an air ejection pipe is provided with an elastic nozzle that undergoes wobbling motion. Although the air discharged from the air ejection pipes with the wobbling nozzles contacts some additional areas and effectively remove fiber waste from them, it has heretofore failed to reach fiber waste generated by engagement of stitches with each other as the stitches clear the knitting needles of the machine. The fiber waste which the air fails to remove tends to enter the needle grooves of the needle cylinder and to adhere thereto due to the presence of oil in such grooves. This of course made it quite difficult to remove the fiber waste.

SUMMARY OF THE INVENTION

The present invention provides relatively simple and low cost apparatus for efficiently removing fiber waste from components of the knitting section of the circular knitting machine. The apparatus includes air ejection nozzles that are located above the sinkers of the knitting machine and that blow air downwardly toward the needle grooves of the needle cylinder. The apparatus further includes a lint collection box adjacent the needle cylinder and the sinker dial, which box receives fiber waste blown toward it by the air discharged from the air ejection nozzles. This helps to prevent scattering of the fiber waste. The apparatus preferably further includes a suction nozzle that communicates with and is located below the lint box, and that assists in conducting the fiber waste into the box, and thereafter in conducting it from the box to a collection source. Use of the apparatus substantially reduces the frequency and duration of the times when the machine must be shut down for cleaning and maintenance.

DESCRIPTION OF THE DRAWINGS

Other features of the invention will be apparent from the following description of an illustrative embodiment thereof, which should be read in conjunction with the accompanying drawings, in which.

DESCRIPTION OF THE PREFERRED EMBODIMENT

Figure 1:
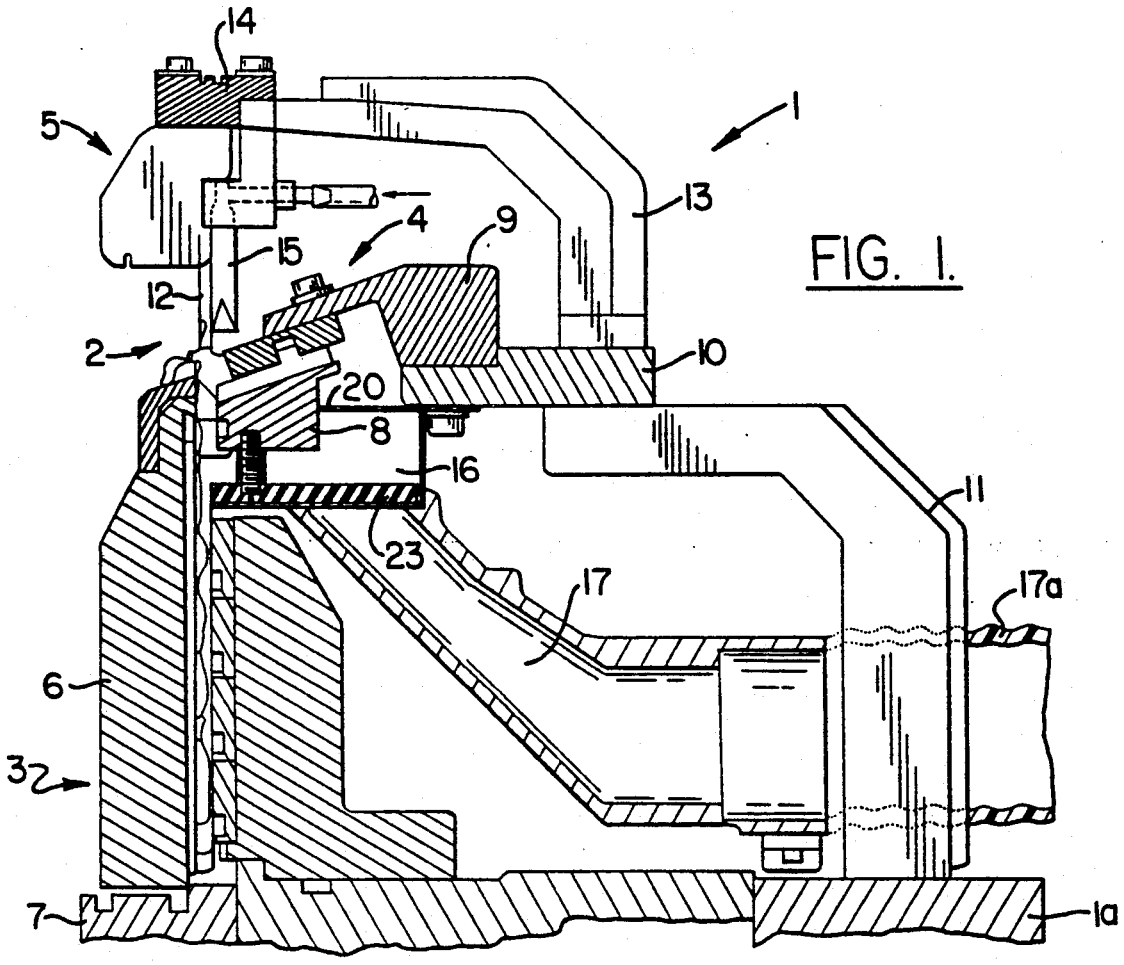
FIG. 1 is a view partially in vertical section and partially in side elevation of knitting section and fiber waste removing components of a circular knitting machine in accordance with the invention.
Figure 2:
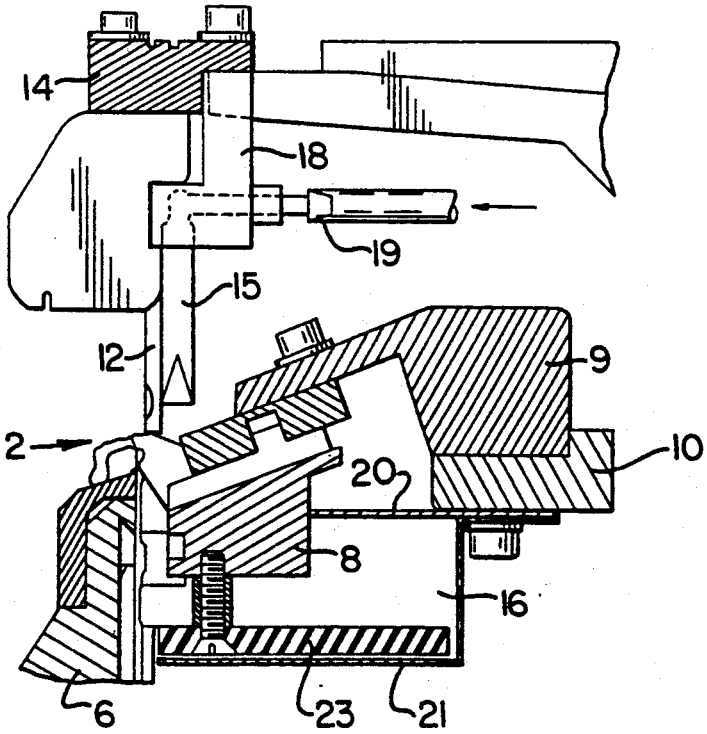
FIG. 2 is an enlarged fragmentary view of components shown in FIG. 1.

The circular knitting machine 1 fragmentarily shown in the drawings includes a knitting section 2 supported upon a bed 1*a* that is supported by a plurality of legs (not shown). Knitting section 2 includes a needle cylinder component 3, sinker component 4, and a yarn carrier component 5.

Needle cylinder component 3 includes a rotary cylinder 6 having on its inner periphery vertical grooves within which knitting needles undergo vertical sliding movement. Needle cylinder component 3 rotates at a speed equal to that of a ring gear 7 underlying cylinder 6.

Sinker component 4 of machine 1 includes a sinker dial 8 having a plurality of sinker grooves within which sinker elements (not shown) are free to undergo radial sliding movement. Sinker component 4 further includes a sinker cap 9 that is supported by an annular ring 10 that is in turn supported by a support member 11 affixed to and extending upwardly from bed 1*a*.

Yarn carrier component 5 includes a yarn carrier 12 that feeds yarn to the knitting needles and is connected to a yarn carrier ring 14 that is connected to an annular ring 10 by a yarn carrier ring support member 13.

In accordance with the present invention, machine 1 further includes an improved apparatus for removing fiber waste from its knitting section. The apparatus includes at least one air ejection nozzle 15 that blows air downwardly from above sinker dial 8 through the needle grooves of the knitting section. The apparatus further includes an annular fiber waste box 16 having upper and lower plate members 20, 21, the latter being of L-shaped configuration. Plate members 20, 21 are secured to the bottom of annular ring 10. The outer edge of upper plate member 20 is adjacent sinker dial 8. The outer edge of the lower section of L-shaped plate member 21 is adjacent the outer periphery of needle cylinder 6.

Figure 3:
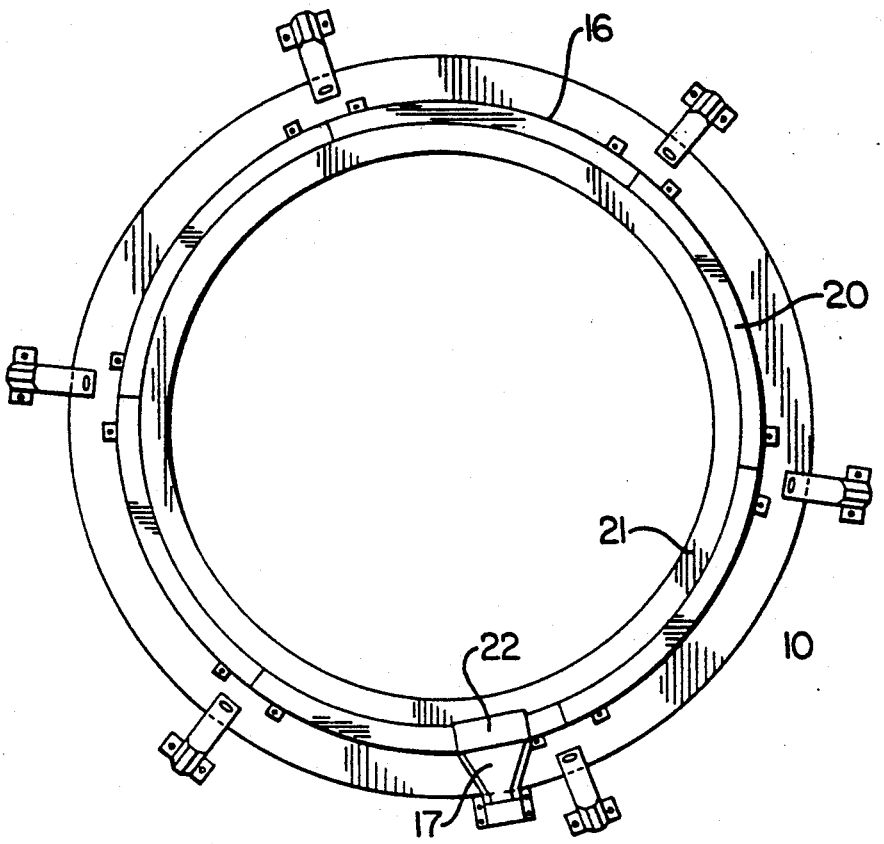
FIG. 3 is a bottom plan view of the annular ring that supports the sinker cap of the machine, and also shows therewith associated components of the lint collection box and a suction nozzle of the fiber waste removal apparatus.

The L-shaped plate member 21 is divided into a plurality of sectors, one of which is provided with a fiber waste outlet opening 22 (FIG. 3). A suction nozzle 17 has an inlet end beneath opening 22 and beneath air ejection nozzle 15. A fiber waste accumulating member 23 formed of rubber or similar resilient material is bolted or otherwise secured to the bottom of sinker dial 8 for rotative movement in box 16 with sinker dial 8. The dimension in a radial direction of elastic member 23 is approximately the same as the radial dimension of plate member 21. The circumferential dimension of plate member 21 preferably is approximately 5–10 mm. More than one member 23 may be provided, although normally a single one of them is sufficient.

Fiber waste entrained by the air blown downwardly by the air ejection nozzle(s) 15 is received in box 16 through its open outer side and is accumulated by rotation of member 23 and conducted by it to opening 22 of box 16. The fiber waste is then sucked from chamber through nozzle 17 and conduit 17*a* to a suction and collection chamber (not shown) disposed outside of machine 1.

The suction nozzle 17 may if desired be secured upon bed 1 by a magnet or the like, for easy removal when desired.

The combined air ejection and air suction forces of the lint removal system of the present invention efficiently remove fiber waste produced by engagement of yarns with each other as they clear the knitting needles in the knitting machine.

While a preferred embodiment of the invention has been shown and described, this was for purposes of illustration only, and not for purposes of limitation, the scope of the invention being in accordance with the following claims.

We claim:

1. Apparatus for removing fiber waste from a circular knitting machine having a rotary needle cylinder and a rotary sinker dial, comprising:

a fiber waste collection box adjacent said rotary needle cylinder and said sinker dial;

an air ejection nozzle located above said sinker dial for discharging air downwardly toward said needle cylinder and said box;

a rotatable fiber waste collecting member within said box; and suction means for removing fiber waste from said box.

2. Apparatus as in claim 1, wherein said box is comprised of at least three members.

3. Apparatus as in claim 1, wherein said air ejection nozzle and said suction means are in generally aligned relationship with each other.

4. Apparatus as in claim 1, wherein said box is of annular shape.

5. Apparatus as in claim 1, wherein said box has an outlet opening and said suction means includes a suction nozzle communicating with said opening.

6. Apparatus as in claim 1, wherein said fiber waste collecting member is connected to and rotatable with said sinker dial.

7. Apparatus as in claim 6, wherein said fiber waste collecting member is made of resilient material.

8. Apparatus for removing fiber waste from a circular knitting machine having a rotary needle cylinder and a rotary sinker dial, comprising:

a fiber waste collection box adjacent said rotary needle cylinder and said sinker dial, said box having a fiber waste outlet;

an air ejection nozzle located above said sinker dial for discharging air downwardly toward said needle cylinder and said box; and a fiber waste collecting member carried by and rotatable with said sinker dial, said fiber waste collecting member being located within said box and conducting fiber waste toward said fiber waste outlet of said box.

9. Apparatus as in claim 8, wherein said fiber waste collecting member is made of resilient material.

10. Apparatus as in claim 8, and further including suction means for removing fiber waste from said box.

11. Apparatus for removing fiber waste from a circular knitting machine having a rotary needle cylinder and a rotary sinker dial, comprising:

a fiber waste collection box adjacent said needle cylinder and said sinker dial, said box having a fiber waste outlet; and a fiber waste collecting member located within and movable through said box; said fiber waste collecting member being connected to and movable in unison with said sinker dial.

* * * * *